US008197282B1

(12) United States Patent
Su et al.

(10) Patent No.: US 8,197,282 B1
(45) Date of Patent: Jun. 12, 2012

(54) SMALL FORM-FACTOR PLUGGABLE (SFP) CONNECTOR STRUCTURE AND ASSEMBLY THEREOF

(75) Inventors: Hou-An Su, Keelung (TW); Hai-Wen Yang, Shanxi Province (CN); Xiao-Qiong Liao, Hunan Province (CN)

(73) Assignee: Nextronics Engineering Corp., New Taipei (TW)

( * ) Notice: Subject to any disclaimer, the term of this patent is extended or adjusted under 35 U.S.C. 154(b) by 0 days.

(21) Appl. No.: 13/084,682

(22) Filed: Apr. 12, 2011

(51) Int. Cl.
*H01R 13/60* (2006.01)

(52) U.S. Cl. ..... 439/541.5; 439/540.1

(58) Field of Classification Search ..... 439/541.5, 439/540.1, 607.2–607.26, 607.31, 607.35
See application file for complete search history.

(56) References Cited

U.S. PATENT DOCUMENTS 6,179,653 B1 * 1/2001 Cheng et al. ..... 439/541.5
6,193,550 B1 * 2/2001 Yamashita et al. ..... 439/594
6,264,501 B1 * 7/2001 Hung et al. ..... 439/541.5
6,948,979 B2 * 9/2005 Chien et al. ..... 439/607.04
7,037,136 B1 * 5/2006 Korsunsky et al. ..... 439/607.07
7,261,591 B2 * 8/2007 Korsunsky et al. ..... 439/541
7,421,184 B2 * 9/2008 Long ..... 385/146
7,575,471 B2 * 8/2009 Long ..... 439/541.5
7,845,975 B2 * 12/2010 Cheng et al. ..... 439/541.5
2002/0197043 A1 * 12/2002 Hwang ..... 385/134
2006/0003632 A1 * 1/2006 Long ..... 439/608

* cited by examiner

*Primary Examiner* — Tulsidas C Patel
*Assistant Examiner* — Harshad Patel
(74) *Attorney, Agent, or Firm* — Rosenberg, Klein & Lee

(57) ABSTRACT

A small form-factor pluggable (SFP) connector structure is disclosed. The SFP connector structure comprises an insulating body, a plurality of first terminals, a plurality of second terminals, and a metal cover. Two card entry slots are formed vertically on the insulating body. Dovetail structures are formed on the sides of the insulating body. The first and second terminals are disposed on the insulating body and extend into the card entry slots. The metal cover is over the insulating body. Thus, the SFP connectors can be connected in parallel without tolerance variation, hence achieving better alignment. A SFP connector assembly is also disclosed.

15 Claims, 10 Drawing Sheets

SMALL FORM-FACTOR PLUGGABLE (SFP) CONNECTOR STRUCTURE AND ASSEMBLY THEREOF

BACKGROUND OF THE INVENTION

1. Field of the Invention

The instant disclosure relates to a small form-factor pluggable (SFP) connector; more particularly, to an interlock-able SFP connector structure and assembly thereof.

2. Description of Related Art

Transceiver modules are commonly used to interface between the circuit board of communication devices and other network equipments for data communication. Different industrial standards have lead to the birth of various types of networking connectors. For example, the gigabit interface converter (GBIC) is a commonly used transceiver for interfacing between a personal computer and the Ethernet, fiber channel (FC), or other data communication networks.

To maximize the terminal density of networking devices (e.g. switchboard, wiring box, computer I/O port, etc.), a miniaturized transceiver module is desired. The small form-factor pluggable (SFP) module can meet such needs. The advantage of the SFP modules lies in that it is only half the size of a regular GBIC, thus allowing greater terminal density.

Various stacked SFP connector and cage designs have been developed to address the above-mentioned needs. However, the existing designs often employ one-by-one interconnection of the insulated body, and the metal casing of the SFP modules are often insecurely coupled with cumulative tolerance variation. Therefore, conventional SFP connector assemblies tend to suffer from structural warping and misalignment.

To address the aforementioned issues, the Applicant proposes the following solution.

SUMMARY OF THE INVENTION

The instant disclosure provides a SFP connector structure and assembly thereof, wherein the assembly may achieve better structural integrity and alignment.

One aspect of the instant disclosure is to provide a miniature SFP connector structure that comprises: an insulating body having laterally arranged dovetail structures and two vertically spaced card entry slots; a plurality of first terminals and second terminals disposed on the insulating body that extend into the card entry slots; and a metal cover disposed over the insulating body.

Another aspect of the instant disclosure is to provide a SFP connector assembly comprising a plurality of interconnecting insulating bodies. Two card entry slots are vertically spaced on each insulating body. Each insulating body has laterally arranged dovetail structures. A plurality of first terminals and second terminals are disposed on the insulating body and extend into the card entry slots. The insulating bodies are interconnected through the engagement of the lateral dovetail structures. The assembly also has a metal cover that shields the insulating bodies.

For advantages, the dovetail structure of the insulating bodies enables secure interconnection of the connector units in the lateral direction. Therefore, slacks in the structure may be reduced and the tolerance variations can be avoided to ensure proper alignment between connector units. Moreover, the simple structural design may facilitate the reduction in manufacturing cost.

In addition, one metal cover is shared by the insulating bodies to simplify the structural design and save cost. The metal cover also enhances the rigidity of the assembly, removes any potential tolerance variation, and ensures proper alignment.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF PREFERRED EMBODIMENT

First Embodiment

Figure 1:
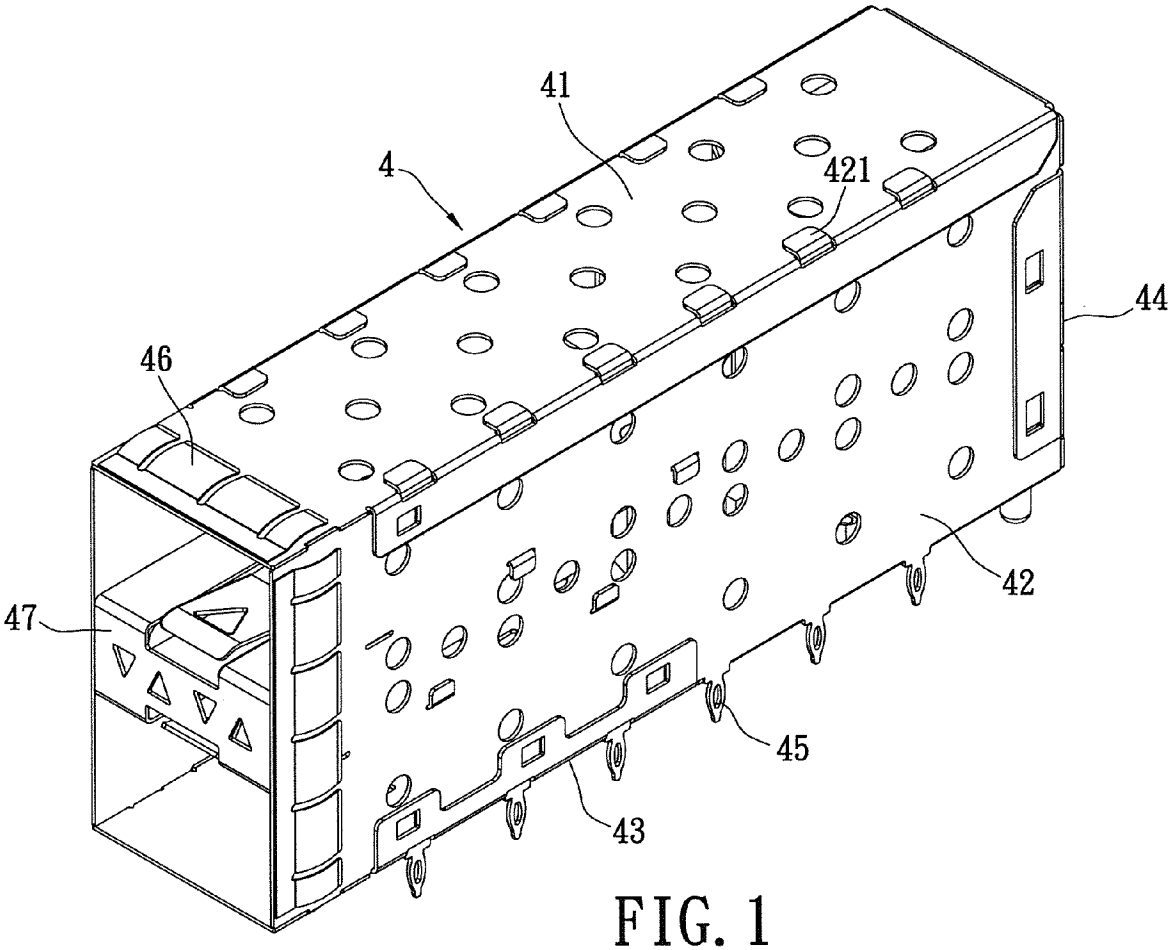
FIG. 1 shows a perspective view of a SFP connector structure of the instant disclosure.
Figure 2:
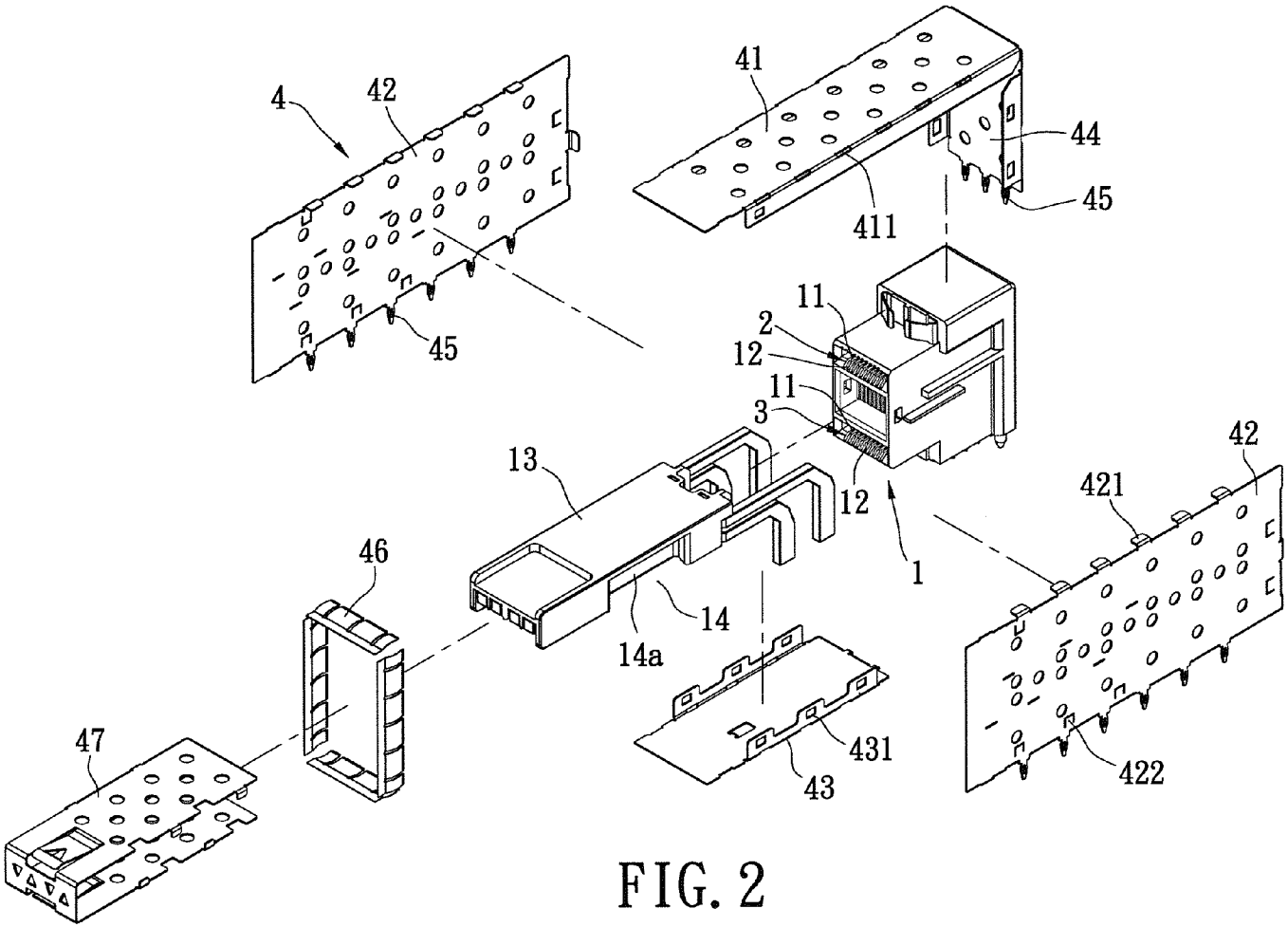
FIG. 2 shows an exploded view of the SFP connector structure of the instant disclosure.
Figure 3:
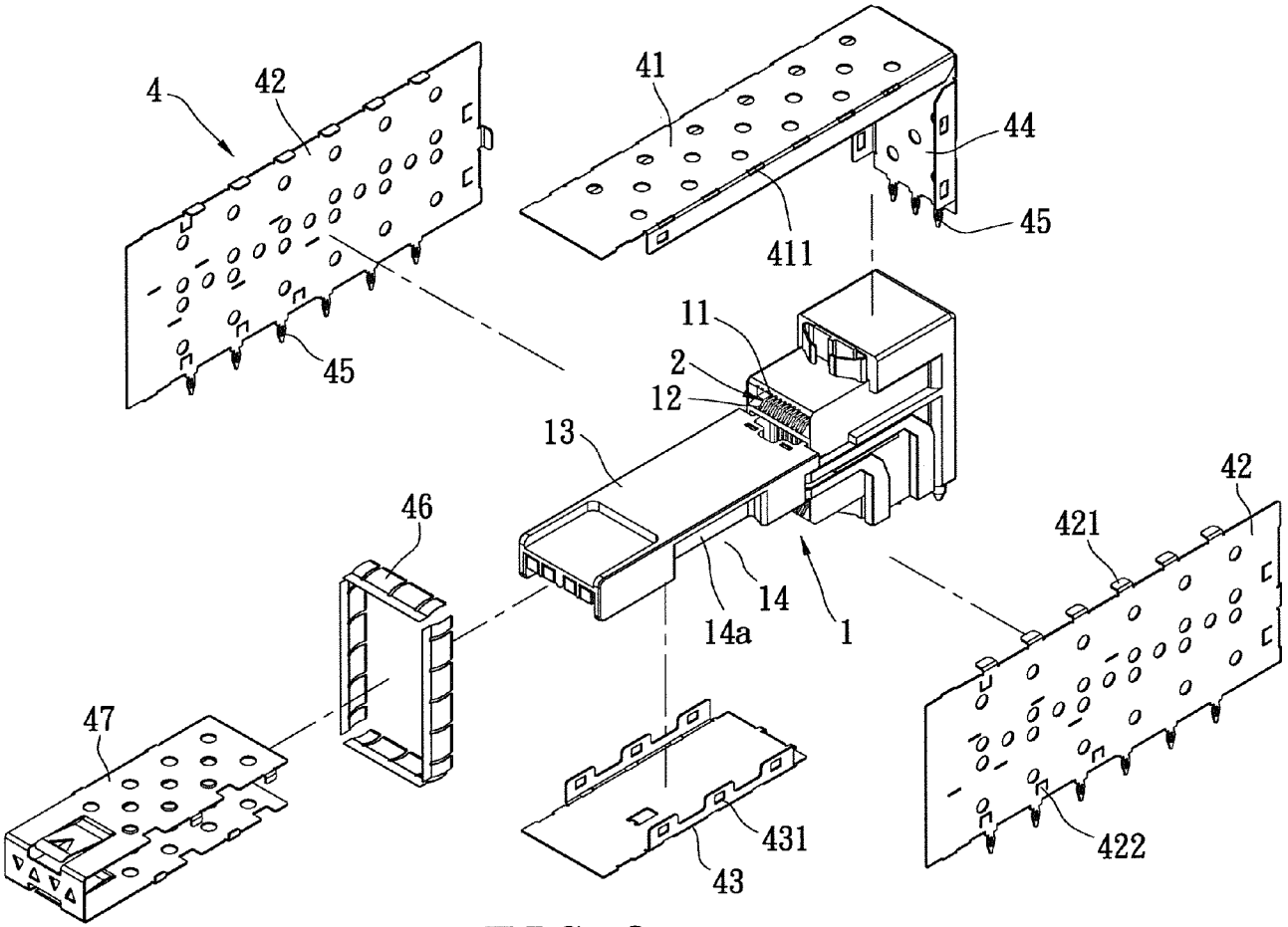
FIG. 3 shows another exploded view of the SFP connector structure of the instant disclosure.
Figure 4:
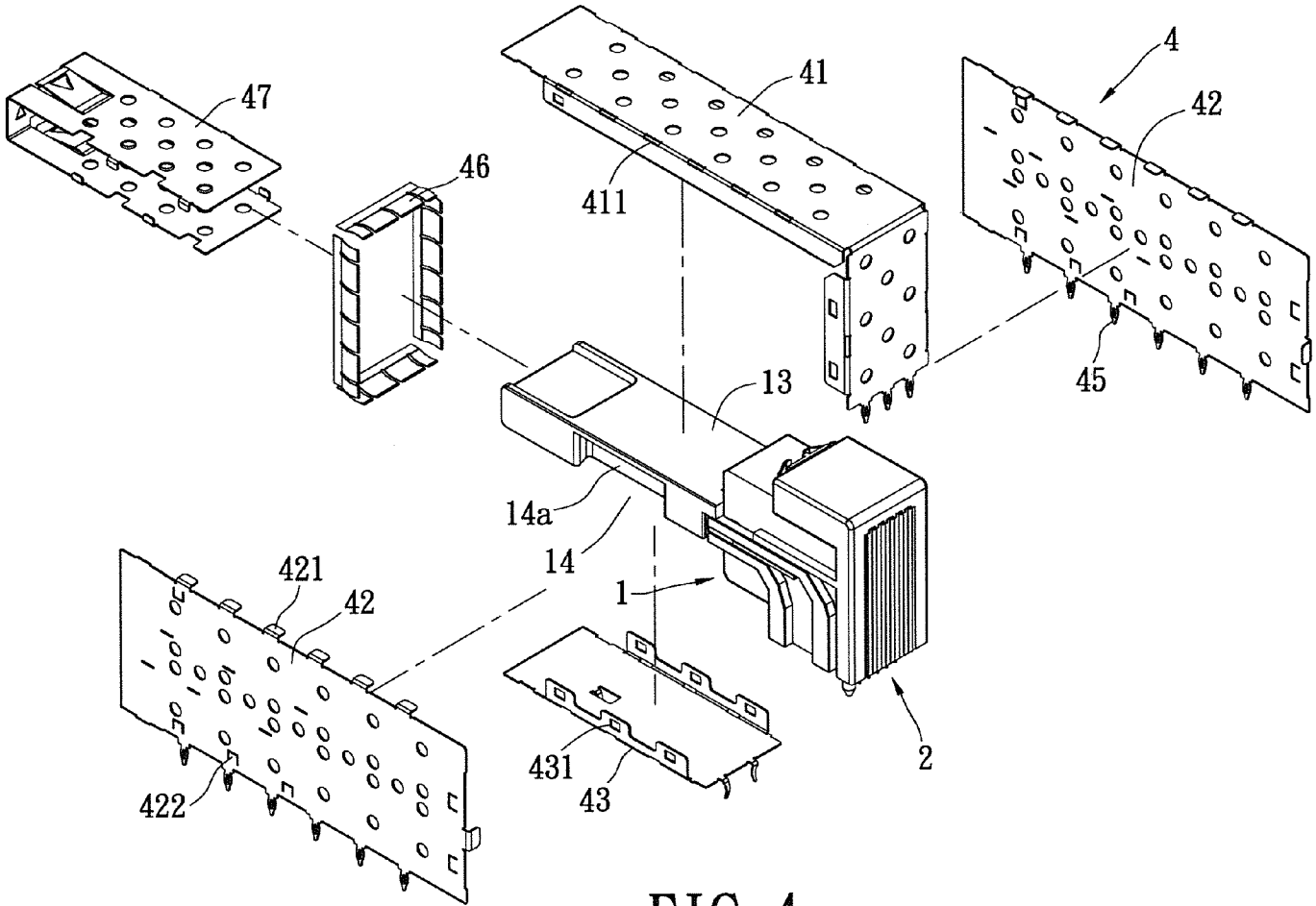
FIG. 4 shows yet another exploded view of the SFP connector structure of the instant disclosure.
Figure 5:
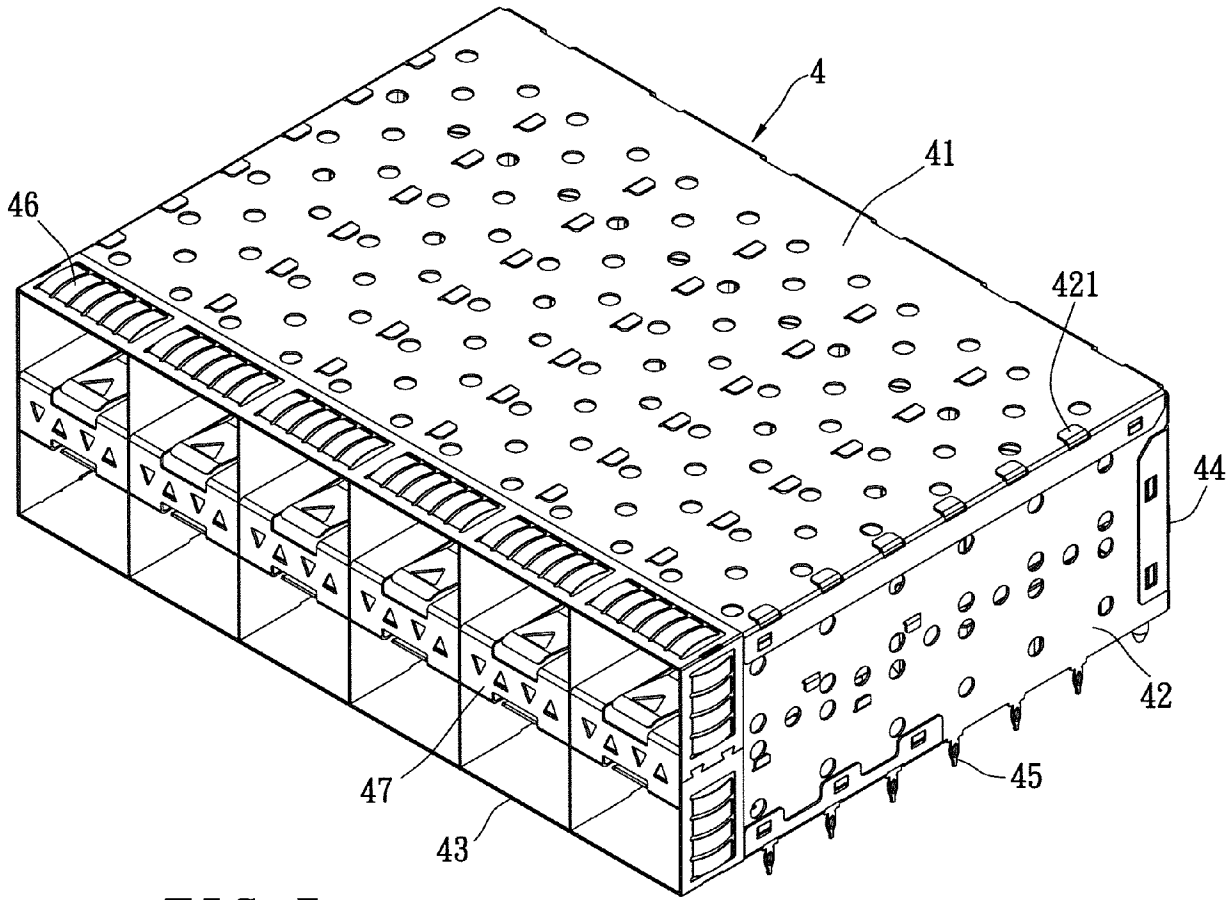
FIG. 5 shows a perspective view of a SFP connector assembly of the instant disclosure.
Figure 6:
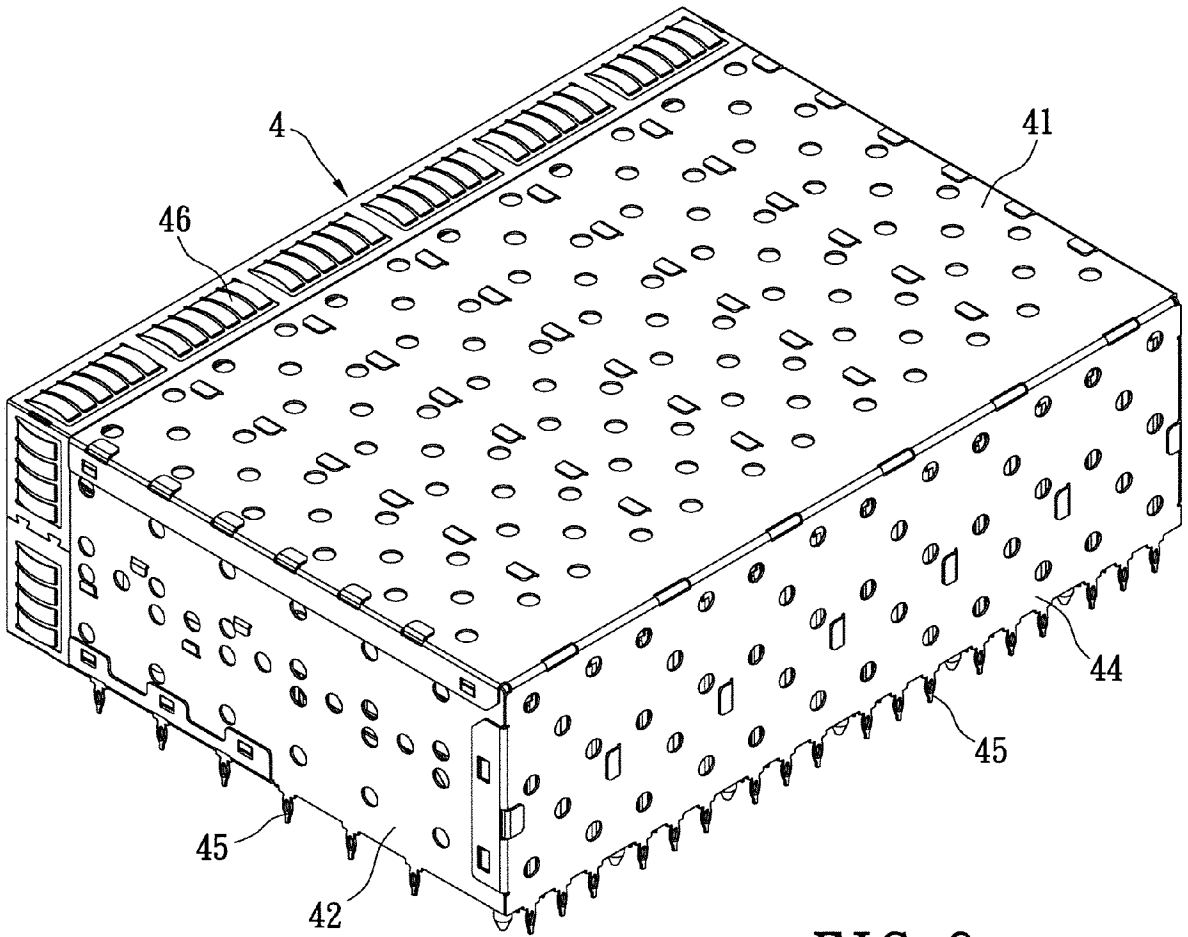
FIG. 6 shows another perspective view of the SFP connector assembly of the instant disclosure.
Figure 7:
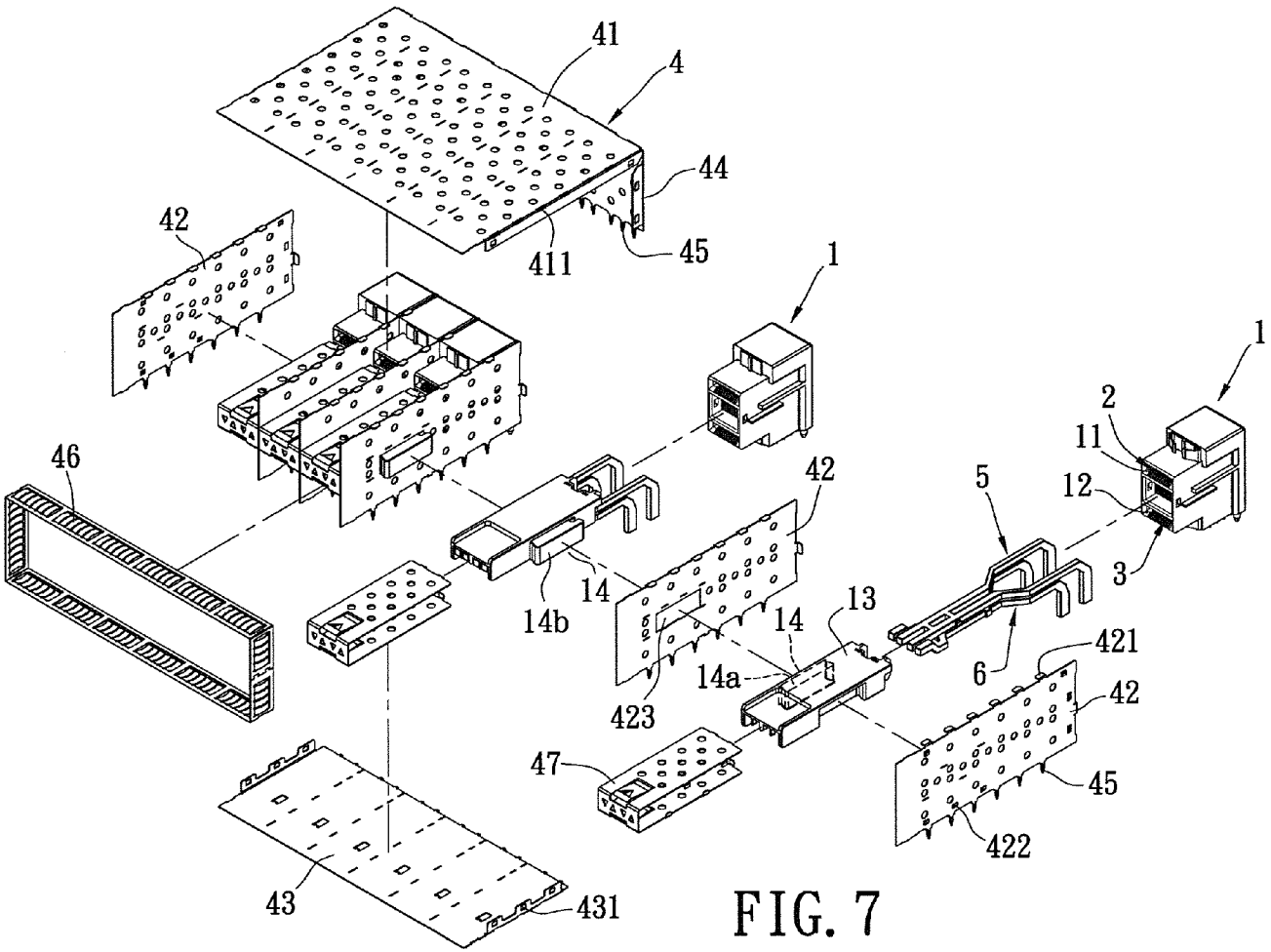
FIG. 7 shows an exploded view of the SFP connector assembly of the instant disclosure.
Figure 8:
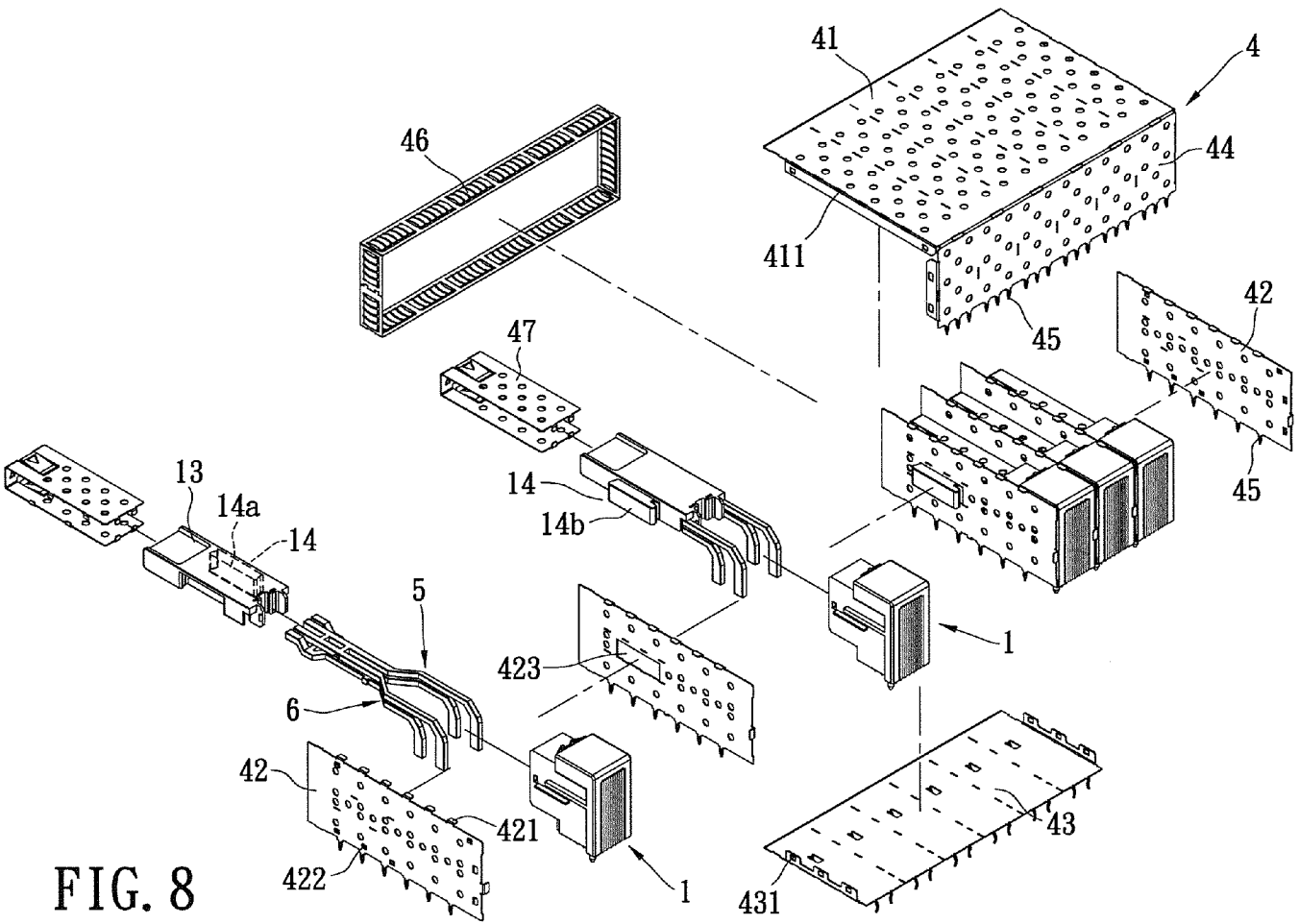
FIG. 8 shows another exploded view of the SFP connector assembly of the instant disclosure.

Please refer to FIGS. 1~4, wherein the instant embodiment provides a standard small form-factor pluggable (SFP) connector structure. The SFP connector structure can be grouped laterally and is a 2×1 configuration, which comprises: an insulating body (or a body) 1; a plurality of first terminals 2; a plurality of second terminals 3; and a metal cover 4. The insulating body 1 is made of insulating material such as plastic, and two card entry slots 11 are vertically formed and spaced apart thereon. A plurality of terminal slots 12 are formed in each card entry slot 11, specifically at the top and bottom side thereof. A divider 13 protrudes away from the card entry slots 11 of the insulating body 1. In particular, the divider 13 can be assembled or formed integrally as part of the insulating body 1. For the instant embodiment, the divider 13 is assembled to the insulating body 1.

Dovetail structures 14 are formed at the sides of the divider 13. The dovetail structure 14 may include wedged recess (tail structure 14*a*) or protrusion (pin structure 14*b*). In other words, both dovetail structures 14 can be a recess, a protrusion, or one dovetail structure being a recess and the other dovetail structure being a protrusion. For the instant embodiment, the dovetail structures 14 are oppositely disposed, and both being a tail structure 14*a*. Because of the dovetail structures 14 on the sides of the divider 13, the SPF connector can interconnect to other SPF connector laterally to form a cage assembly. For the leftmost and rightmost end SPF connector, the dovetail structure 14 of the free side is unused, therefore can be obsoleted. However, to maintain the option of expanding the cage assembly, dovetail structures 14 are disposed on both sides of the divider 13.

The first and second terminals 2, 3 are standard terminals for SFP connector. The first and second terminals 2, 3 are disposed on the insulating body 1 and received by the terminal slots 12. One end of each first and second terminal 2, 3 reside in the upper and lower card entry slots 11 respectively. Functionally, the first and second terminals 2, 3 are for making electrical connections with the mating terminals to the SFP connector. The other end of each first and second terminal 2, 3 are exposed off the bottom of the insulating body 1. The exposed ends can be crimped or soldered onto the circuit board, which becomes electrically connected with the SFP connector.

As a barrier against electromagnetic interference (EMI), the metal cover 4 shields the insulating body 1. The metal cover 4 comprises a top cover 41, two side covers 42, and a bottom cover 43. The top cover 41, side covers 42, and the bottom cover 43 are all rectangular-shaped plates. A rear cover 44 can be formed by extending downward from the rear end of the top cover 41. The top cover 41 and the bottom cover 43 are connected to the top and bottom edges of the side covers 42 respectively. In particular, the top cover 41 clips to the upper edges of the side covers 42. In other words, the sides of the top cover 41 and the upper edges of the side covers 42 have corresponding clipping portion 411 and 421 respectively. The clipping portion 411 and 421 can be an engaging slot for matchingly engaging with a latching member. The bottom cover 43 can also clip to the bottom edges of the side covers 42. Namely, the sides of the bottom cover 43 and the bottom edges of the side covers 42 have corresponding clipping portion 431 and 422 respectively. The clipping portion 431 and 422 can be an engaging slot for matchingly engaging with a latching member. Likewise, the rear cover 44 can clip to the back edges of the side covers 42 in the same way.

A plurality of pin contacts 45 are extended from the bottom edges of the metal cover 4. In particular, the pin contacts 45 are extended from the bottom edge of each side cover 42 and the rear cover 44. The pin contacts 45 are for plugging or soldering to the circuit board for securing the SFP connector. A plurality of ground springs 46 can be disposed near the front end of the metal cover 4, over the top cover 41, the side covers 42, and the bottom cover 43. The ground springs 46 projects outwardly from the metal cover 4, wherein the ground springs 46 can contact to a ground source (not shown) to suppress electromagnetic interference (EMI).

A metal divider 47 can be centrally disposed within the cover 4. The metal divider 47 is made of metal plates and locks to the side covers 42, wherein the metal divider 47 covers the divider 13 of the insulating body 1. Functionally, the metal divider 47 and the divider 13 separate the enclosure defined by the metal cover 4 into an upper and lower compartment. Thus, two mating connectors can be accommodated, with the metal cover 47 separating the two modules.

Second Embodiment

Please refer to FIGS. 5~8, wherein the instant embodiment provides a standard small form-factor pluggable (SFP) connector assembly. The SFP connector assembly comprises the insulating bodies 1, wherein each insulating body 1 includes the first terminals 2 and the second terminals 3. The first and second terminals 2, 3 have similar structural configurations as the first embodiment, so no further elaboration is repeated herein.

Two light pipes 5, 6 can further be disposed on each divider 13. Each light pipe 5, 6 can be a separate unit by itself to guide its own light. The number of light pipes 5, 6 is not restricted. The light pipes 5, 6 are locked to the bottom portion of the divider 13.

Figure 9:
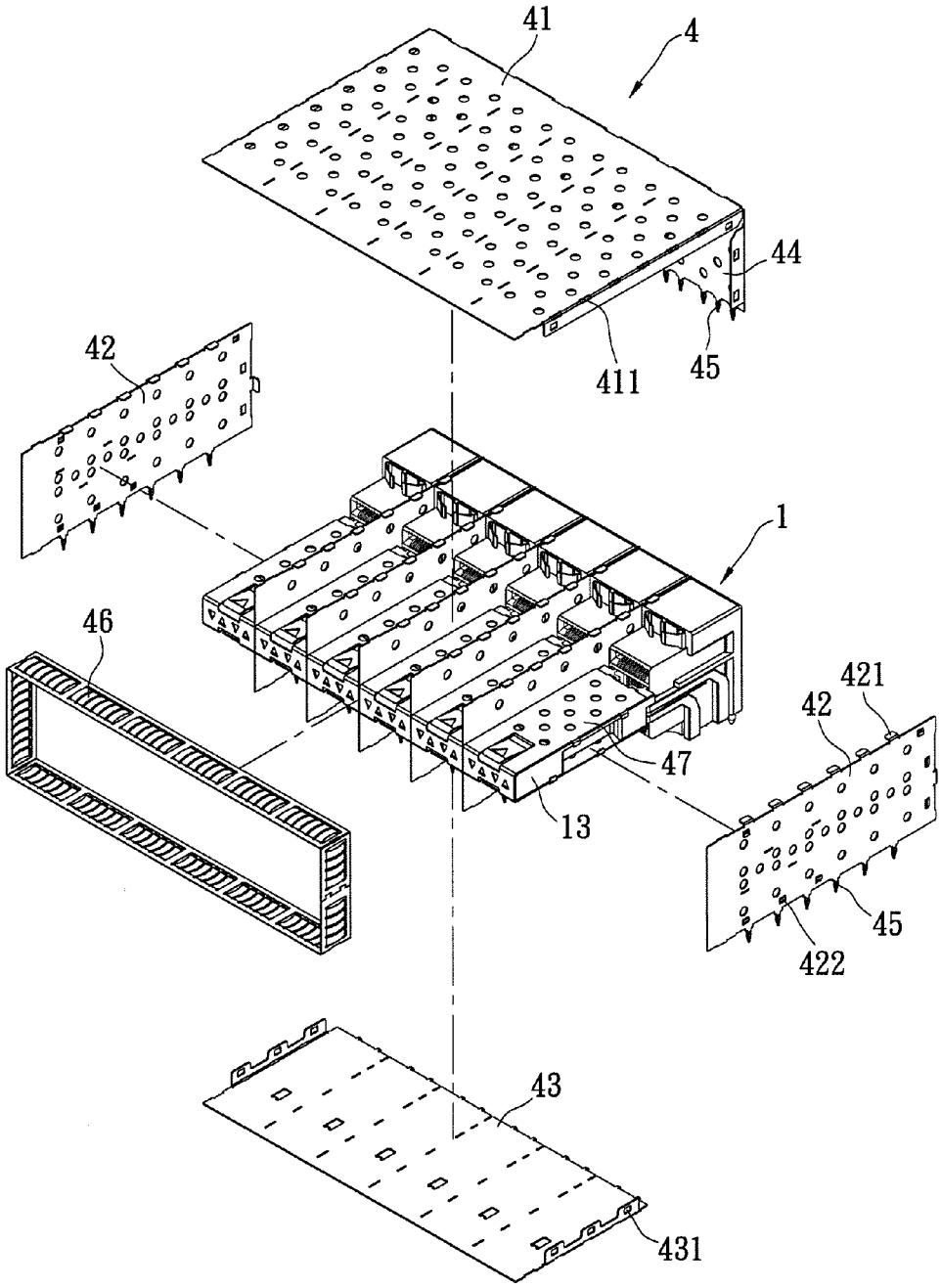
FIG. 9 shows yet another exploded view of the SFP connector assembly of the instant disclosure.
Figure 10:
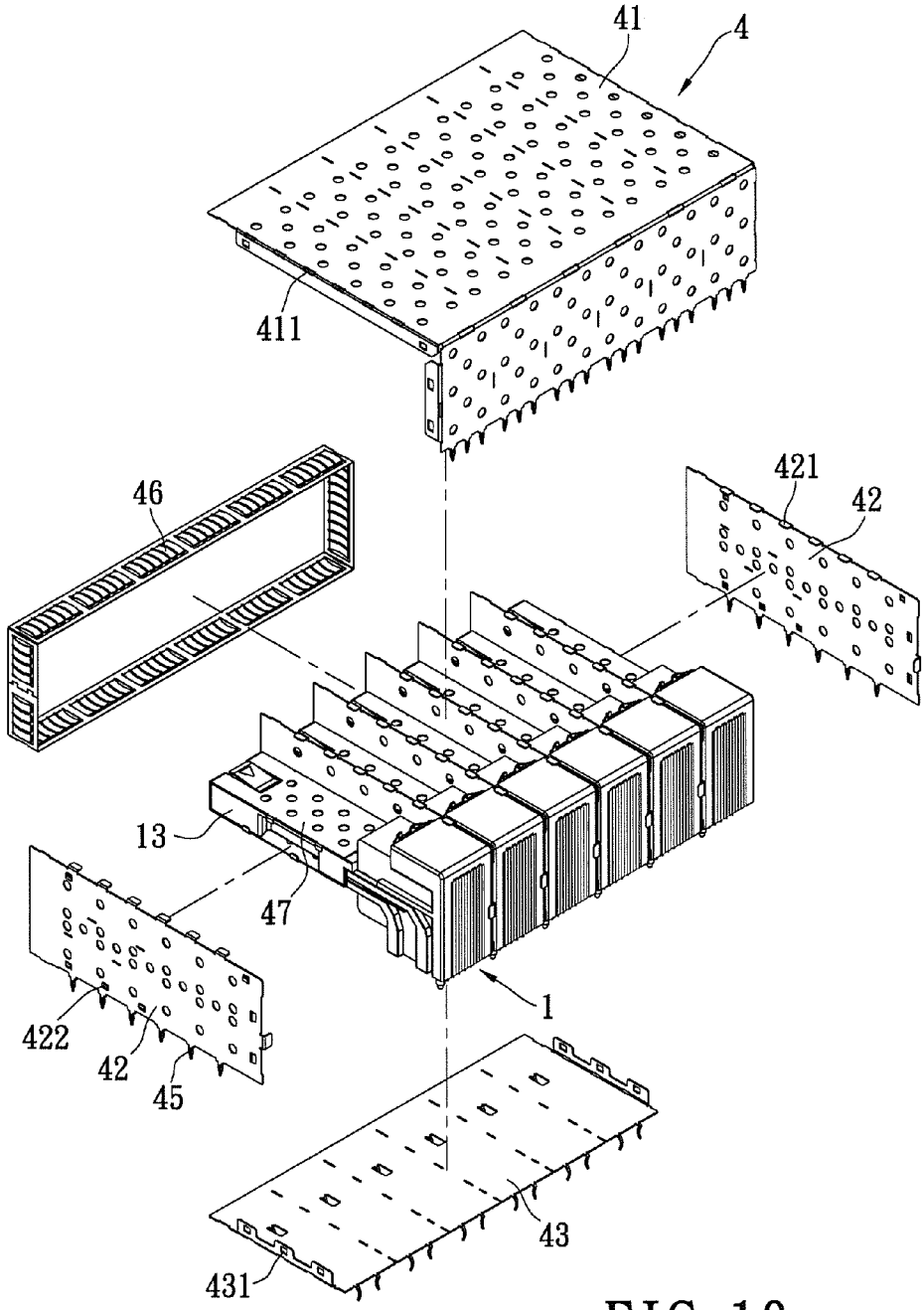
FIG. 10 shows still another exploded view of the SFP connector assembly of the instant disclosure.

The insulating bodies 1 are disposed in parallel. The dovetail structures 14 of the adjacent sides of the insulating bodies 1 are tail structure 14*a* and pin structure 14*b*, for engaging the adjacent insulating bodies 1 (as shown in FIGS. 9 and 10). The aforementioned side cover 42 is disposed in between each insulating body 1. For the side cover 42 in between each insulating body 1, an opening 423 is formed on the side cover 42 to slide over the pin structure 14*b*, so the pin structure 14*b* can secure to the tail structure 14*a*.

For the instant embodiment, the metal cover 4 can be over the insulating bodies 1. The metal cover comprises the top cover 41, the side covers 42, and the bottom cover 43. The side covers 42 are disposed intermittently between the insulating bodies 1. The top cover 41 is connected to the upper edges of the side covers 42, and the bottom cover 43 is connected to the bottom edges of the side covers 42. The width of the top cover 41, the bottom cover 43, and the rear cover 44 of the metal cover 4 depends on the number of the insulating bodies 1. For example, for six insulating bodies 1, the width of the top cover 41, the bottom cover 43, and the rear cover 44 of the metal cover 4 is increased sixfold to form a 2×6 configuration. The metal dividers 47 are centrally disposed within the metal cover 4 and over the dividers 13 of the insulating bodies 1. The number of the insulating bodies and the corresponding width of the metal cover 4 are not restricted, but depend on the application requirement instead.

Both aforementioned embodiments are for stacked SFP connectors. In other words, each insulating body 1 has two vertically disposed card entry slots 11. The first terminals 2 and the second terminals 3 extend into the respective card entry slot 11. For another embodiment (not shown), the SFP connector can be a single or stacked standard. Namely, each insulating body can have one or more card entry slot. Each insulating body further has a plurality of terminals that extend into one or more card entry slot. Furthermore, the divider 13 can be replaced by a metal-grade divider (not shown) for heat dissipation. If made of plastic, the divider 13 can be color-coded for identification purpose.

The instant disclosure uses a single or plurality of insulating bodies 1 to expand the SFP connector. Dovetail structures 14 (e.g. tail structure 14*a* and pin structure 14*b*) are formed on the sides of the insulating body 1 of the SFP connector to connect with other connectors in parallel. Each side cover 42 sandwiched by the insulating bodies 1 slides over the dovetail structure 14 of the insulating body 1. Thus, dovetail structure 14 of one insulating body 1 can secure to the dovetail structure 14 of another insulating body 1 to expand the assembly. The dovetail structure 14 functions to align, hold, and support the insulating bodies 1. By being more rigid, the connection between dovetail structures 14 prevents tolerance differences and provides better alignment when connecting the connectors. In addition, the SFP connector assembly using dovetail structures 14 is structurally simple to manufacture, therefore can save cost.

The top and bottom cover 41 and 43 are added after first expanding the assembly. Since the top and bottom cover 41 and 43 are precision-made, the addition would eliminate any potential tolerance variation of the SFP connector assembly.

Furthermore, the insulating bodies 1 of the instant disclosure shares a single metal cover 4. The single metal cover 4 provides structural simplification, ease in assembling, and is cost-effective. By covering over the insulating bodies 1, the metal cover 4 can increase the structural integrity thereof and eliminate any potential tolerance variation. Thus, the SFP connector assembly can have better alignment.

For the instant disclosure, the connection points protrude from the top cover 41 and the bottom cover 43. So, when crimping the SFP connector to the circuit board, no special tool is needed. The connection points also allow easier crimping process.

Also, the side covers 42 and the top cover 41 are removably engaged to each other. Less material is used to make the individual cover versus manufacturing the whole cover integrally in one piece. Therefore, the manufacturing cost can be lowered.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A small form-factor pluggable (SFP) connector structure, comprising:

an insulating body having two card entry slots spaced vertically thereon; a plurality of first terminals and a plurality of second terminals disposed on the insulating body, the first and second terminals extend into the respective card entry slots; a metal cover disposed over the insulating body; and a divider disposed in front of the insulating body, the divider being assembled to or integrally formed with the insulating body, the divider including two dovetail structures respectively formed on two side surfaces.

2. The SFP connector structure of claim 1, wherein the dovetail structures include interlockable pin structures and tail structures.

3. The SFP connector structure of claim 1, wherein the metal cover comprises a top cover, two side covers, and a bottom cover, wherein the top cover is connected to the upper edges of two side covers, and wherein the bottom cover is connected to the bottom edges of two side covers.

4. The SFP connector structure of claim 3, wherein the top cover clips to the upper edges of two side covers, and wherein the bottom cover clips to the bottom edges of two side covers.

5. The SFP connector structure of claim 3, wherein a rear cover is formed by extending from the rear end of the top cover, and wherein the sides of the rear cover are connected to the back edges of two side covers.

6. The SFP connector structure of claim 3, wherein said dovetail structures are tail structures, pin structures, or the combination thereof.

7. The SFP connector structure of claim 1, wherein a metal divider is centrally disposed within the enclosure defined by the metal cover, and wherein the metal divider shields the divider of the insulating body.

8. The SFP connector structure of claim 1, wherein said dovetail structures are tail structures, pin structures, or the combination thereof.

9. A SFP connector assembly, comprising:

a plurality of insulating bodies each having a pair of card entry slots spaced vertically thereon; a plurality of first terminals and second terminals are disposed on each insulating body, the first and second terminals extending into the respective card entry slots of the insulating body, the insulating bodies being arranged in parallel; a divider disposed in front of each insulating body, each divider being assembled to a respective one of the insulating bodies or formed integrally with the respective insulating body, each divider including a pair of dovetail structures formed on side surfaces thereof the dividers, the dovetail structures include interlockable tail structures and pin structures, adjacent insulating bodies being respectively coupled one to another by adjacent dovetail structures of corresponding dividers being respectively interlocked, thereby connecting the insulating bodies in parallel by the engagement of the pin and tail structures; and a metal cover disposed over the insulating bodies.

10. The SFP connector assembly of claim 9, wherein the metal cover comprises a top cover, a plurality of side covers, and a bottom cover, and wherein the side covers are arranged in intervals separated by the insulating bodies, the top cover being connected to the upper edges of the side covers, the bottom cover being connected to the bottom edges of the side covers.

11. The SFP connector assembly of claim 10, wherein the top cover is clipped to the upper edges of the side covers, and wherein the bottom cover is clipped to the lower edges of the side covers.

12. The SFP connector assembly of claim 10, wherein a rear cover is formed by extending from the rear end of the top cover.

13. The SFP connector assembly of claim 9, wherein a plurality of dividers is centrally disposed within the enclosure defined by the metal cover, and wherein the metal dividers cover the dividers.

14. The SFP connector assembly of claim 9, wherein at least one light pipe is disposed on each divider.

15. A SFP connector assembly, comprising:

a plurality of insulating bodies, each having at least one card entry slot formed thereon and a pair of laterally arranged dovetail structures, the dovetail structures including interlockable tail structures and pin structures; a metal cover disposed over the bodies; and a plurality of terminals are disposed on each insulating body and extending into the card entry slot thereof, the plurality of insulating bodies being arranged in parallel, the corresponding dovetail structures of adjacent to insulating bodies being respectively interlocked, so that the insulating bodies are connected together by an engagement between mating tail and the pin structures;

wherein the metal cover comprises a top cover, a plurality of side covers, and a bottom cover, the plurality of side covers being arranged in intervals separated by the insulating bodies, the top cover being connected to the upper edges of the side covers, the bottom cover being connected to the bottom edges of the side covers, at least a portion of the plurality of side covers having an opening formed therethrough in correspondence with a respective pin structure for passage thereof through the opening to engage an adjacent tail structure.

* * * * *